US009302145B2

(12) United States Patent
Chang

(10) Patent No.: US 9,302,145 B2
(45) Date of Patent: Apr. 5, 2016

(54) ELLIPTICAL EXERCISE MACHINE WITH ADJUSTABLE STRIDE LENGTH

(71) Applicant: Rexon Industrial Corp., Ltd., Taichung (TW)

(72) Inventor: Yao Jen Chang, Taichung (TW)

(73) Assignee: REXON INDUSTRIAL CORP., LTD., Taichung (TW)

( * ) Notice: Subject to any disclaimer, the term of this patent is extended or adjusted under 35 U.S.C. 154(b) by 0 days.

(21) Appl. No.: 14/526,795

(22) Filed: Oct. 29, 2014

(65) Prior Publication Data

US 2015/0119201 A1 Apr. 30, 2015

(30) Foreign Application Priority Data

Oct. 29, 2013 (TW) ..... 102139085 A

(51) Int. Cl.

| | |
|---|---|
| ***A63B 22/00*** | (2006.01) |
| ***A63B 22/04*** | (2006.01) |
| ***A63B 71/00*** | (2006.01) |
| ***A63B 22/06*** | (2006.01) |

(52) U.S. Cl.

CPC ..... *A63B 22/001* (2013.01); *A63B 22/0015* (2013.01); *A63B 22/0664* (2013.01); *A63B 2022/0682* (2013.01)

(58) Field of Classification Search

CPC ..... A63B 22/00; A63B 22/0002; A63B 22/0005; A63B 22/0007; A63B 22/001; A63B 22/0015; A63B 22/0017; A63B 22/0025; A63B 22/0046; A63B 22/0048; A63B 22/0056; A63B 22/04; A63B 22/06; A63B 22/0605; A63B 22/0664; A63B 2022/0043; A63B 2022/0051; A63B 2022/0611; A63B 2022/0617; A63B 2022/0629; A63B 2022/0635; A63B 2022/067; A63B 2022/0676; A63B 2022/0682; A63B 2022/0688

USPC ..... 482/51–52, 66; 280/29

See application file for complete search history.

(56) References Cited

U.S. PATENT DOCUMENTS

| | | | | |
|---|---|---|---|---|
| 7,182,714 | B2 * | 2/2007 | Moon | A63B 22/001 482/52 |
| 7,468,021 | B2 | 12/2008 | Moon | |
| 7,874,961 | B2 * | 1/2011 | McKee | A63B 22/0007 482/52 |
| 8,864,631 | B1 * | 10/2014 | Stearns | A63B 22/0664 482/51 |
| 2003/0236152 | A1 * | 12/2003 | Lo | A63B 22/0015 482/52 |
| 2007/0265143 | A1 * | 11/2007 | Stearns | A63B 22/001 482/52 |
| 2009/0247370 | A1 * | 10/2009 | Stearns | A63B 22/001 482/52 |

* cited by examiner

*Primary Examiner* — Oren Ginsberg
*Assistant Examiner* — Joshua Lee
(74) *Attorney, Agent, or Firm* — Bacon & Thomas, PLLC

(57) ABSTRACT

An elliptical exercise machine with adjustable stride length includes a frame, a driving unit, an adjustment unit, and a coupling unit. The driving unit includes two pedals, a pair of handlebars and a pair of wheels. The handlebars and the wheels are correspondingly and respectively mounted to the frame. A crank is interposed between the wheels. Two pedal shafts are pivotally and respectively mounted between each wheel and each handlebar. The adjustment unit includes a stationery member mounted to the frame, a driving member mounted to the stationery member, and a linearly movable coupling member. The coupling unit includes two first shafts pivotally connected to the coupling member, two second shafts respectively and pivotally mounted between each handlebar and each first shaft. Two bars are pivotally and respectively engaged to each second shaft and the crank. Thereby, a stride length of the two pedals can be simultaneously adjusted.

12 Claims, 7 Drawing Sheets

ELLIPTICAL EXERCISE MACHINE WITH ADJUSTABLE STRIDE LENGTH

FIELD OF THE INVENTION

The present invention relates to exercise equipment, and in particular to an elliptical exercise machine with adjustable stride length.

BACKGROUND

In an elliptical exercise machine as disclosed in U.S. Pat. No. 7,468,021, the length of left and right adjustment arms may be adjusted to adjust left and right stride lengths respectively, and thus it is inconvenient and time-consuming to adjust the stride lengths. Furthermore, the left and right stride lengths may be different, since the lengths of the left and right adjustment arms may be different after making the adjustment. Therefore, there exists a problem of sports injury.

In view of the aforementioned problems, it is a main subject for the present invention to provide an elliptical exercise machine with adjustable stride length to overcome the problems of the prior art.

SUMMARY OF THE INVENTION

To achieve the aforementioned objective, the present invention provides an exercise machine with adjustable stride length, wherein the left and right stride lengths can be adjusted synchronously to provide a convenient and time-consuming ellipse.

Therefore, it is a primary objective of the present invention to provide an elliptical exercise machine with adjustable stride length comprising a frame, a driving unit, an adjustment unit and a coupling unit.

The driving unit comprises two handlebars, two wheels, a crank, two pedal shafts and two pedals, wherein the two handlebars are pivotally coupled to the frame, and the two wheels are rotatably installed at the frame, and the crank is installed between the two wheels, and each pedal shaft has a first front pivoting portion pivotally coupled to the bottom of each handlebar, and a first rear pivoting portion coupled to the crank, and the two pedals being installed to the first rear pivoting portions of the two pedal shafts respectively.

The adjustment unit includes a fixed seat mounted to the frame, a coupling member installed at the fixed seat and linearly moved between the first position and the second position and with respect to the driving member.

The coupling unit includes two first shafts, two second shafts and two pull rods, and each first shaft having a first top pivoting portion and a first bottom pivoting portion pivotally coupled to the driving member, and each second shaft has a second top pivoting portion pivotally coupled to the first bottom pivoting portion, and a second bottom pivoting portion pivotally coupled to the handlebar, and each pull rod has a second front pivoting portion pivotally coupled to the second top pivoting portion, and a second rear pivoting portion coupled to the crank.

Therefore, when the driving member transmits the coupling member to move linearly, the coupling member drives the two first shafts synchronously to change the positions of the two first shafts, the two second shafts and the two pull rods to adjust the elliptical stride length of the two pedals synchronously.

BRIEF DESCRIPTION OF THE DRAWINGS

Advantages and features of the present invention will be understood by reference to the following description in conjunction with the accompanying drawings, in which like reference numbers denote like elements of structure and component parts.

Figure 1:
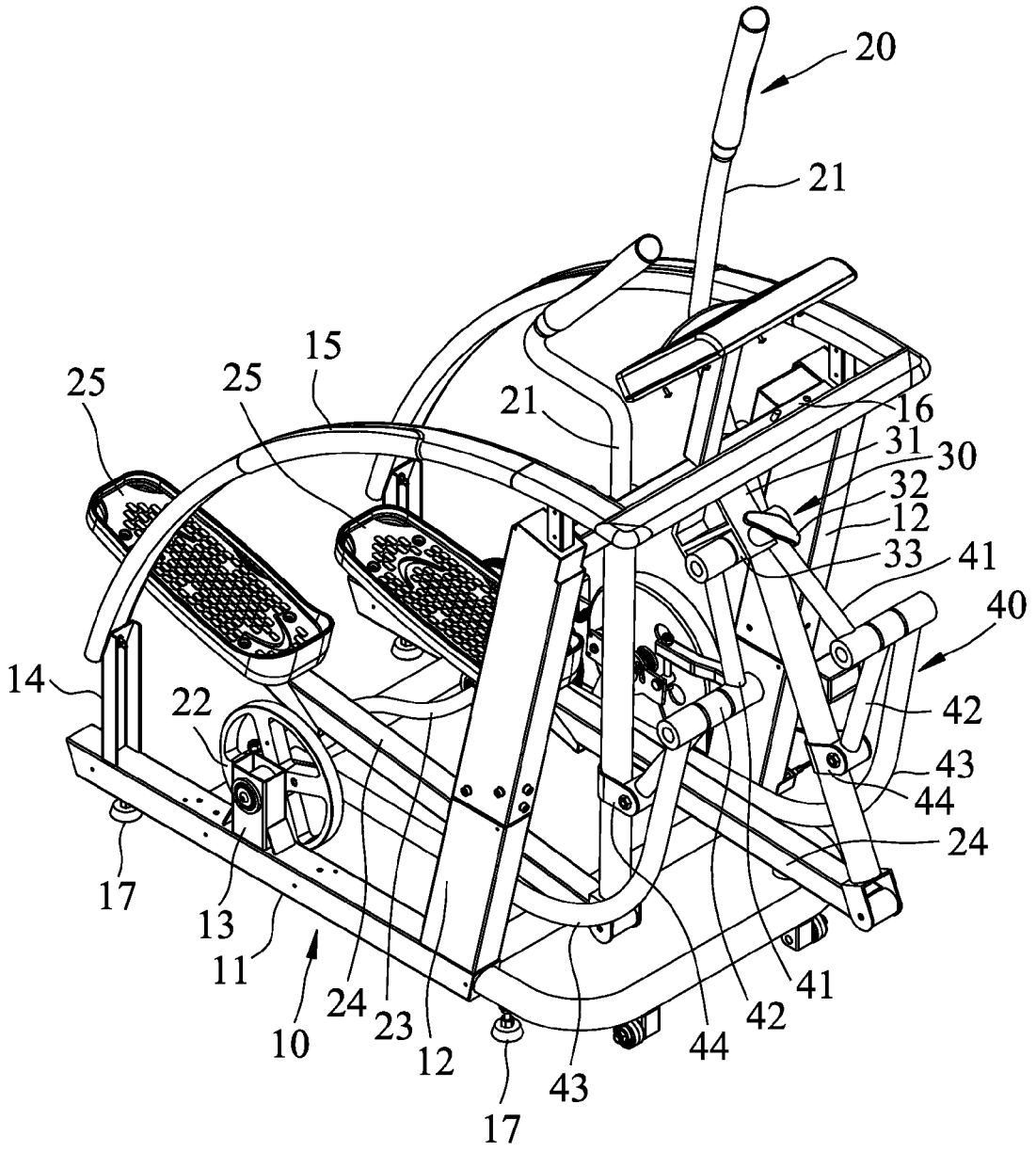
FIG. 1 is a perspective view of an elliptical exercise machine with adjustable stride length of a preferred embodiment of the present invention.

It should be noted that the drawing figures are not necessarily drawn to scale, but instead are drawn to provide a better understanding of the components thereof, and are not intended to be limiting in scope, but rather to provide exemplary illustrations. It should further be noted that the figures illustrate exemplary embodiments of the present invention and the components thereof, and in no way limits the structures, configurations and components thereof according to the present disclosure.

DETAILED DESCRIPTION

The present invention will become clearer in light of the following detailed description of an illustrative embodiment of this invention described in connection with the drawings. It is intended that the embodiments and drawings disclosed herein are to be considered illustrative rather than restrictive.

Figure 2:
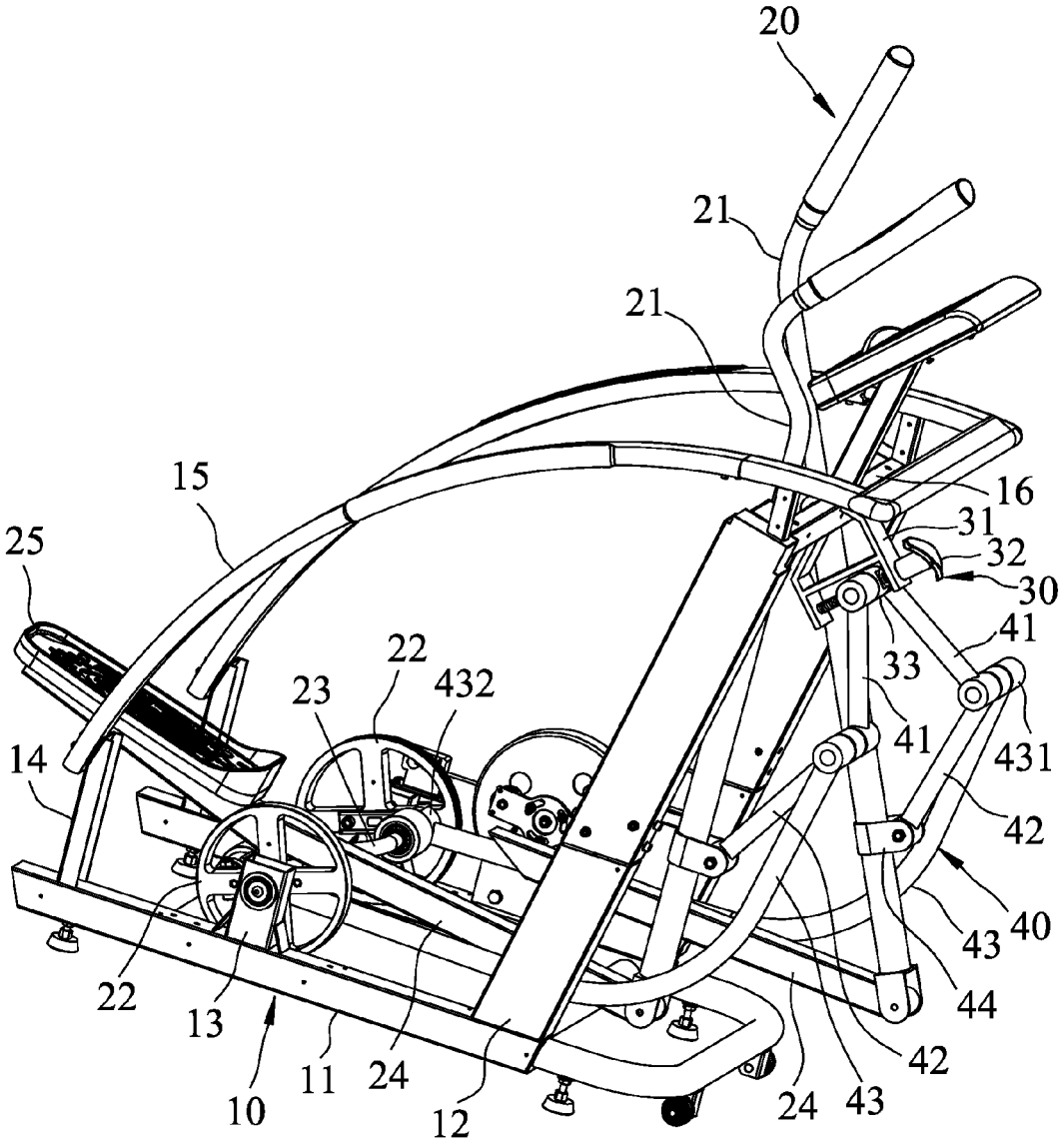
FIG. 2 is a perspective view of another preferred embodiment clearly showing a wheel and a pull rod without showing a pedal.
Figure 3:
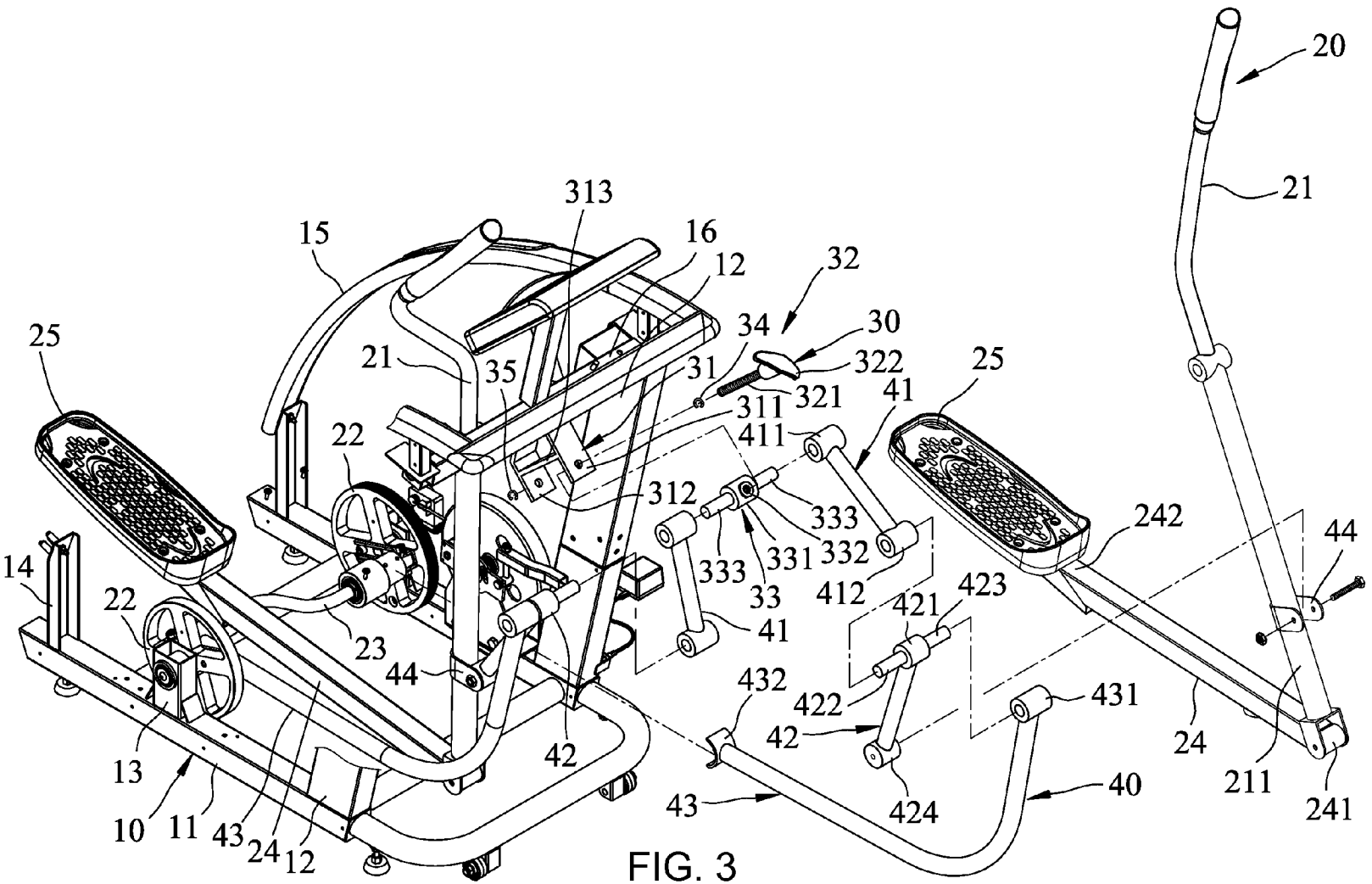
FIG. 3 is a partial exploded view of the preferred embodiment showing a frame, a driving unit, an adjustment unit and a coupling unit.

With reference to FIGS. 1, 2 and 3 for an elliptical exercise machine with adjustable stride length in accordance with preferred embodiments of the present invention, the elliptical exercise comprises a frame 10, a driving unit 20, an adjustment unit 30 and a coupling unit 40.

The frame 10 includes a U-shaped base 11, two front columns 12, two middle columns 13 and two rear columns 14 fixed to both left and right sides of the base 11 respectively, a top seat 15 disposed between the two front columns 12 and the two rear columns 14, a front ejector 16 installed between the two front columns 12 and along a left-right sideway direction, and a plurality of footers 17 installed at the bottom of the base 11.

The driving unit 20 includes two handlebars 21, two wheels 22, a crank 23, two pedal shafts 24 and two pedals 25. The two handlebars 21 are respectively and pivotally coupled to the two front columns 12 and along a front-rear direction, and each of the two handlebars 21 has a bottom 211, and the two wheels 22 are respectively and rotatably installed at the middle column 13, and the crank 23 is installed between the two wheels 22, and each pedal shaft 24 has a first front pivoting portion 241 pivotally coupled to the bottom 211 of each handlebar 21, and a first rear pivoting portion 242 coupled to the crank 23, and the two pedals 25 are installed and fixed to the two first rear pivoting portions 242 respectively.

The adjustment unit 30 includes a fixed seat 31, a driving member 32, and a linking member 33 mounted to the frame 10.

The fixed seat 31 has a top piece 311 and a bottom piece 312 parallel to each other, and fixed to the front ejector 16 and tilted towards the front bottom end of the fixed seat 31, and a connecting piece 313 perpendicularly coupled to the top piece 311 and the bottom piece 312.

The driving member 32 is installed at the fixed seat 31 and has a screw 321 screwed to the top piece 311 and the bottom piece 312 and arranged parallel to the connecting piece 313, and a knob 322 sheathed to the top of the screw 321 and disposed outside the top piece 311.

The linking member 33 is secured to the screw 321 and has a main body 331, a radial screw hole 332 formed on the main body 331 for securing the screw 321, and two first axial shafts 333 extended from the main body 331 in opposite directions and perpendicular to the radial screw hole 332.

A top buckle 34 and a bottom buckle 35 are clamped and fixed to the screw 321 and disposed on outer sides of the top piece 311 and the bottom piece 312 respectively, so that the screw 321 can be rotated at its original position without producing a linear movement.

The coupling unit 40 includes two first shafts 41, two second shafts 42, two L-shaped pull rods 43, and two pivot seats 44 mounted to the two handlebars 21 respectively.

Each first shaft 41 has a first top pivoting portion 411 sheathed on and pivotally coupled to a first axial shaft 333 of the linking member 33, and a first bottom pivoting portion 412.

Each second shaft 42 has a second top pivoting portion 421 pivotally coupled to the first bottom pivoting portion 412, and a second bottom pivoting portion 424 pivotally coupled to the pivot seat 44, and each second top pivoting portion 421 has a second axial shaft 422 and a third axial shaft 423 extended in opposite direction from each other. The first bottom pivoting portion 412 of each first shaft 41 is sheathed on and pivotally coupled to the second axial shaft 422, and each second bottom pivoting portion 424 is pivotally coupled to the pivot seat 44.

Each pull rod 43 has a second front pivoting portion 431 sheathed on and pivotally coupled to the third axial shaft 423, and a pivoting portion 432 coupled to a second rear of the crank 23.

In this preferred embodiment, the first top pivoting portion 411 and the first bottom pivoting portion 412 of the first shaft 41 and the second front pivoting portion 431 of the pull rod 43 are sockets.

Figure 4:
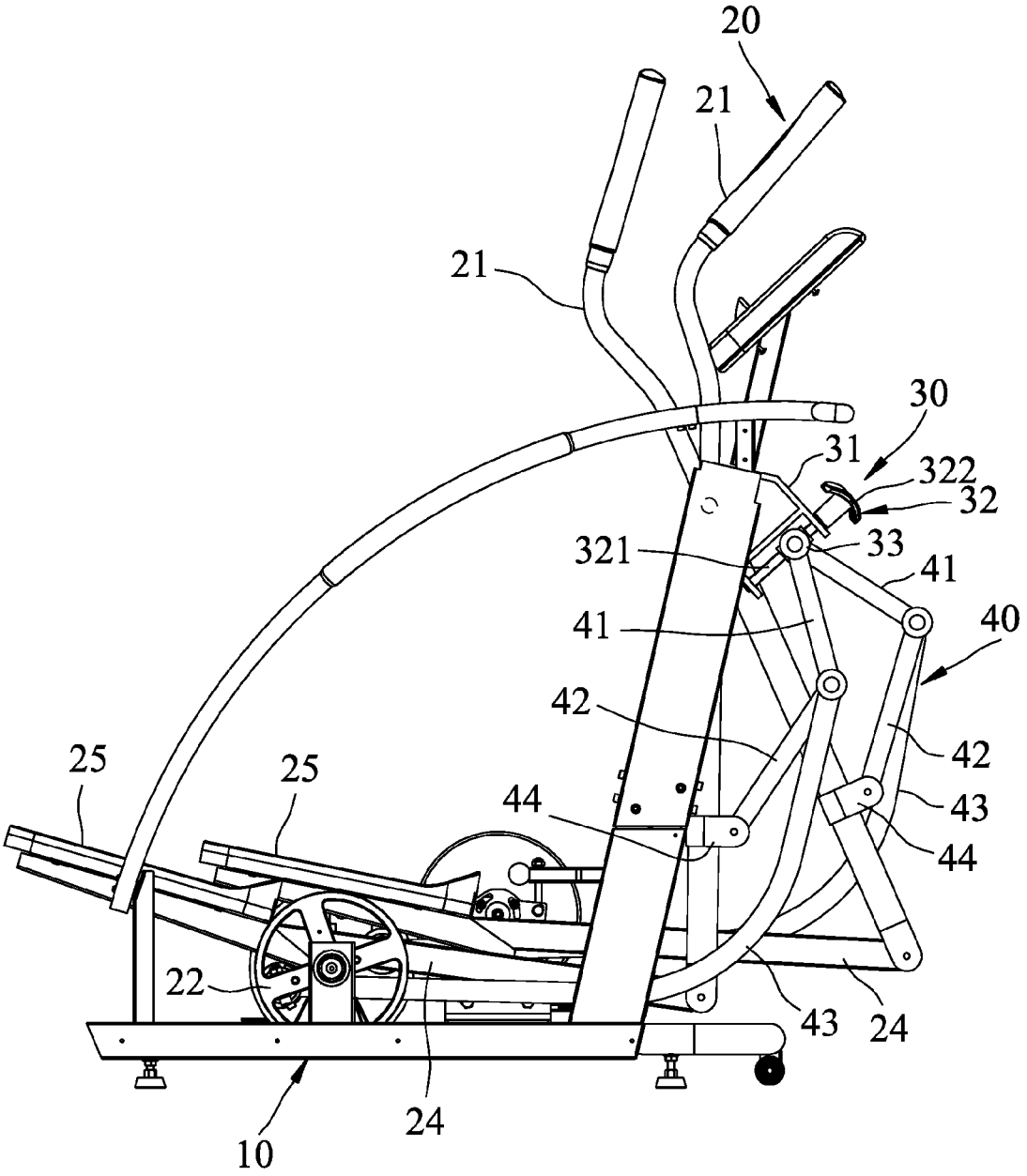
FIG. 4 is a side view of the preferred embodiment, showing the status of adjusting the stride length.
Figure 5:
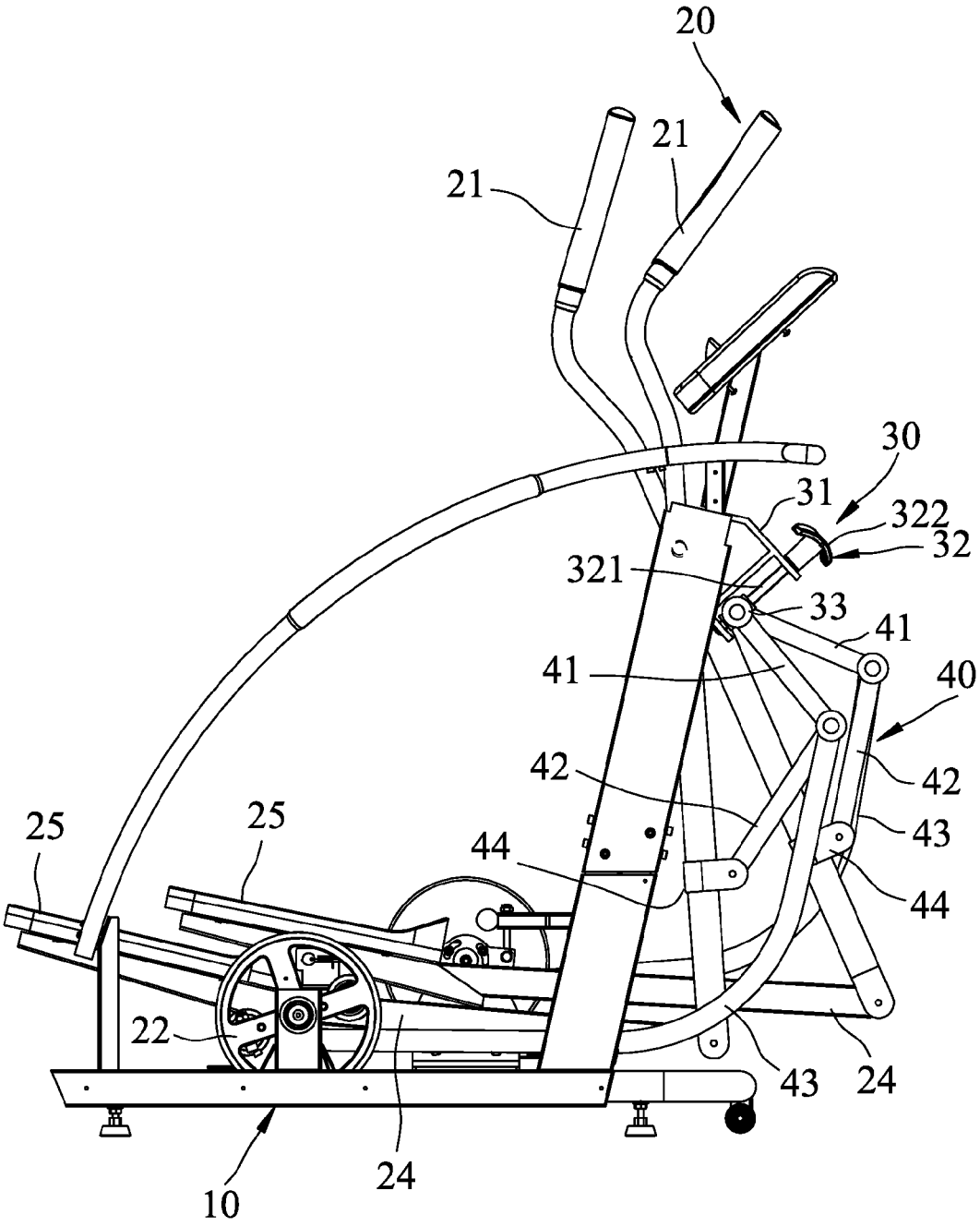
FIG. 5 is a view similar to FIG. 4, showing the status after adjusting the stride length.

In an application as shown in FIG. 4, when the linking member 33 of the adjustment unit 30 is situated at a first position opposite to the screw 321 of the driving member 32, a link rod mechanism comprising the driving unit 20 and the coupling unit 40 drives the two pedals 25 to produce a first elliptical stride as shown in FIG. 5. If it is necessary to adjust the elliptical stride of the two pedals 25, the user just needs to turn the knob 322 to rotate the screw 321 at its original position in order to move the linking member 33 to a second position with respect to the screw 321, and the linking member 33 can synchronously link the two first shafts 41, the two second shafts 42 and the two pull rods 43 to change the positions of the two first shafts 41, the two second shafts 42 and the two pull rods 43, so as to change the link rod mechanism comprised of the driving unit 20 and the coupling unit 40. Therefore, the two pedals 25 produce a second elliptical stride, and the second elliptical stride length is different from the first elliptical stride length. As a result, the elliptical stride can be adjusted appropriately to fit different users and prevent sports injuries.

Figure 6:
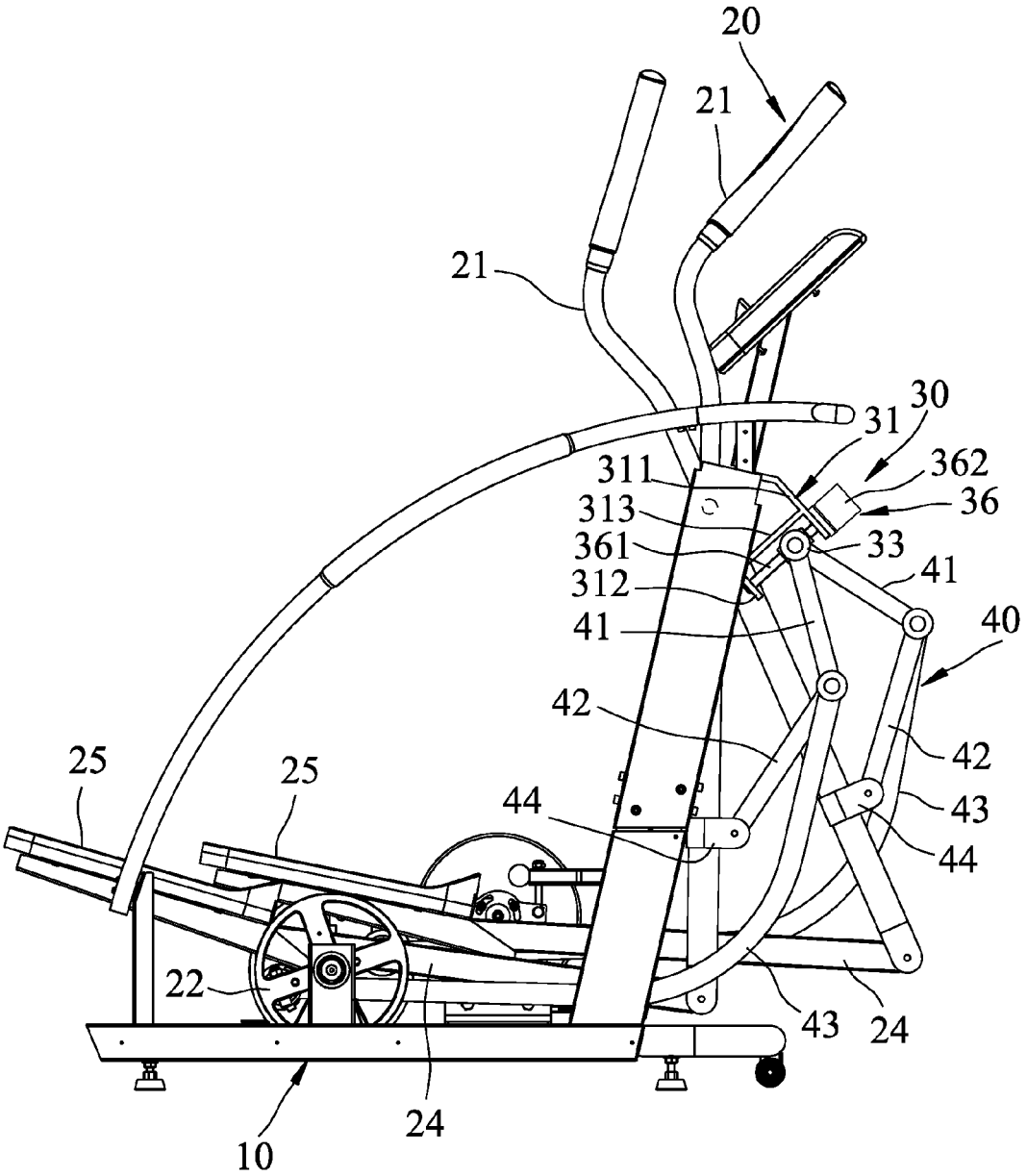
FIG. 6 is a view similar to FIG. 4, showing another adjustment unit and the status before adjusting the stride length.
Figure 7:
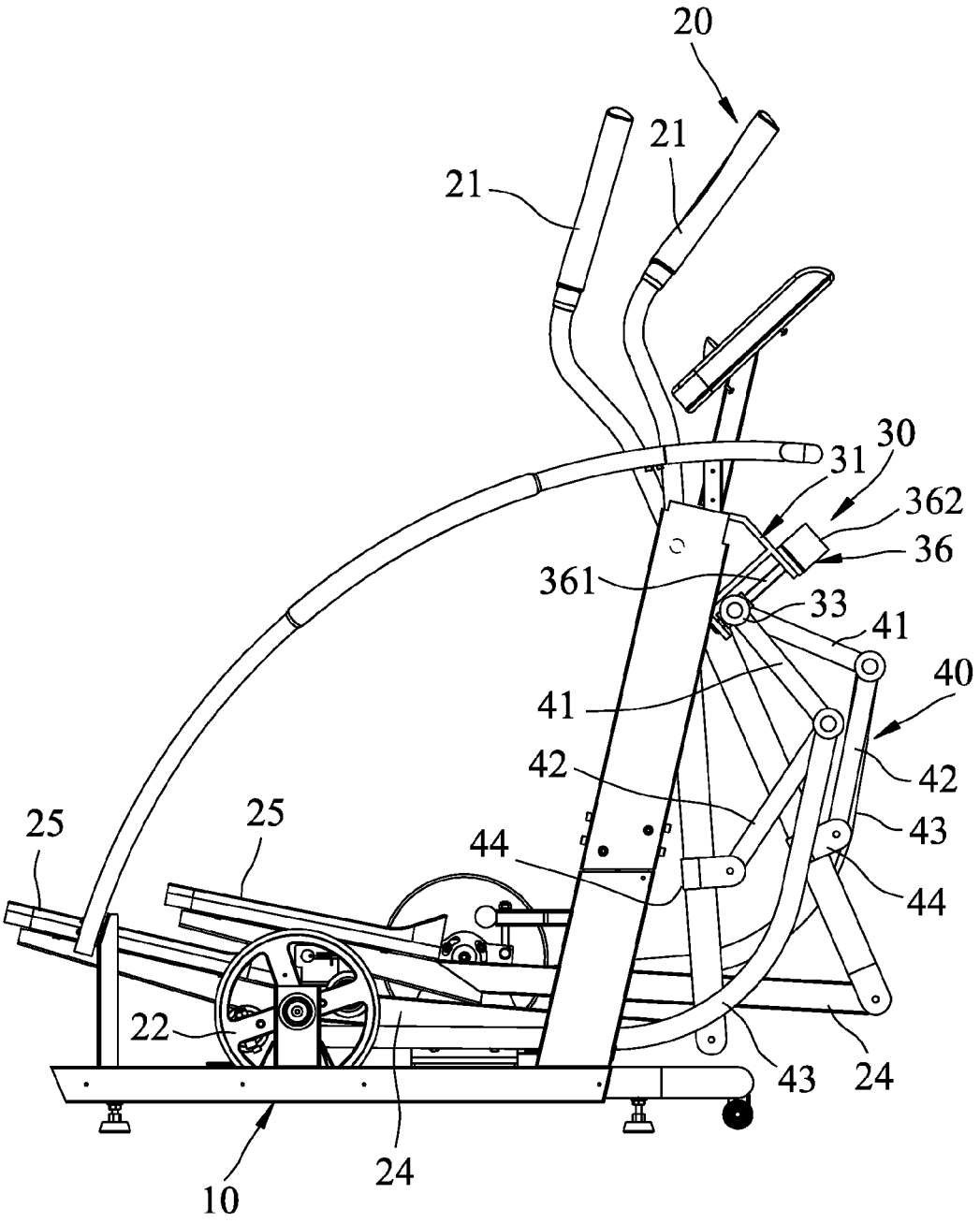
FIG. 7 is a view similar to FIG. 6, showing the status after adjusting the stride length.

It is noteworthy that the driving member 32 of the adjustment unit 30 may come with a manually operating design or an electrically operated design. In FIG. 6, the driving member 36 includes a screw 361 passed and installed to the top piece 311 and the bottom piece 312 and arranged parallel to the connecting piece 313, and a motor 362 mounted onto the top piece 311 for transmitting the screw 361. When the motor 362 is turned on, the screw 361 is transmitted and rotated at its original position, so that the linking member 33 can move linearly between the first position and the second position opposite to the screw 361. When the linking member 33 is situated at the first position, the two pedals 25 can produce a first elliptical stride. In FIG. 7, when the linking member 33 is situated at the second position, the two pedals 25 can produce a second elliptical stride.

In summation of the description above, the elliptical exercise machine with adjustable stride length of the present invention has the following effects and advantages: the driving members 32, 36 are operated to linearly move the linking member 33 with respect to the screws 321, 361 and between the first position and the second position and synchronously link the two first shafts 41, the two second shafts 42, and the two pull rods 43 to synchronously adjust the elliptical stride lengths of the two pedals 25 to provide a convenient and time-saving application. In addition, the elliptical exercise machine maintains the elliptical stride lengths of the two pedals 25 equally to avoid sports injuries.

What is claimed is:

1. An elliptical exercise machine with adjustable stride length, comprising:

a frame;

a driving unit, including two handlebars, two wheels, a crank, two pedal shafts and two pedals, and the two handlebars being pivotally coupled to the frame, and the two wheels being rotatably installed at the frame, and the crank being installed between the two wheels, and each pedal shaft having a first front pivoting portion pivotally coupled to a bottom of each handlebar, and a first rear pivoting portion coupled to the crank, and the two pedals being installed to the first rear pivoting portions of the two pedal shafts respectively;

an adjustment unit, including a fixed seat mounted to the frame, a coupling member installed at the fixed seat and linearly moved between a first position and a second position and with respect to a driving member;

a coupling unit, including two first shafts, two second shafts and two pull rods, and each first shaft having a first top pivoting portion pivotally coupled to the coupling member and a first bottom pivoting portion, and each second shaft having a second top pivoting portion pivotally coupled to the first bottom pivoting portion, and a second bottom pivoting portion pivotally coupled directly to the handlebar, and each pull rod having a second front pivoting portion pivotally coupled to the second top pivoting portion, and a second rear pivoting portion coupled to the crank;

such that when the driving member transmits the coupling member to move linearly, the coupling member drives the two first shafts synchronously to change positions of the two first shafts, the two second shafts and the two pull rods to adjust an elliptical stride length of the two pedals synchronously.

2. The elliptical exercise machine with adjustable stride length according to claim 1, wherein the driving member has a screw passed and installed to the fixed seat, and a knob sheathed on top of the screw.

3. The elliptical exercise machine with adjustable stride length according to claim 1, wherein the driving member has a screw passed and installed to the fixed seat, and a motor mounted onto the fixed seat for transmitting the screw.

4. The elliptical exercise machine with adjustable stride length according to claim 2, wherein the driving member has a main body, a radial screw hole formed at the main body for screwing the screw, and two first axial shafts extended in opposite directions from the main body and perpendicular to the radial screw hole.

5. The elliptical exercise machine with adjustable stride length according to claim 4, wherein the coupling unit further includes two pivot seats fixed to the two handlebars respectively, and the second bottom pivoting portions of the two second shafts are pivotally coupled to the two pivot seats, and the second top pivoting portion of each second shaft has a second axial shaft and a third axial shaft, and the first bottom pivoting portion of each first shaft is sheathed on the second axial shaft, and the second front pivoting portion of each pull rod is sheathed on the third axial shaft.

6. The elliptical exercise machine with adjustable stride length according to claim 1, wherein the frame includes a base, two front columns, two middle columns and two rear columns fixed to the base, two top seats disposed between the two front columns and the two rear columns, and a front ejector installed between the two front columns, and the two handlebars are respectively and pivotally coupled to the two front columns, and the two wheels are installed to the two middle columns respectively, and the fixed seat is fixed to the front ejector.

7. The elliptical exercise machine with adjustable stride length according to claim 6, wherein the fixed seat has a top piece and a bottom piece parallel to each other and fixed to the front ejector, and a connecting piece coupled to the top piece and the bottom piece, and the driving member has a screw passed and installed to the top piece and the bottom piece, and a top sheathed to the screw and disposed at a knob outside the top piece.

8. The elliptical exercise machine with adjustable stride length according to claim 6, wherein the fixed seat has a top piece and a bottom piece parallel to each other and fixed to the front ejector, and a connecting piece coupled to the top piece and the bottom piece, and the driving member has a screw passed and installed to the top piece and the bottom piece, and a motor installed onto the top piece for transmitting the screw.

9. The elliptical exercise machine with adjustable stride length according to claim 7, wherein the adjustment unit further includes a top buckle and a bottom buckle clamped and fixed to the screw and disposed at outer sides of the top piece and the bottom piece respectively.

10. The elliptical exercise machine with adjustable stride length according to claim 8, wherein the adjustment unit further includes a top buckle and a bottom buckle clamped and fixed to the screw and disposed at outer sides of the top piece and the bottom piece respectively.

11. The elliptical exercise machine with adjustable stride length according to claim 3, wherein the driving member has a main body, a radial screw hole formed at the main body for screwing the screw, and two first axial shafts extended in opposite directions from the main body and perpendicular to the radial screw hole.

12. The elliptical exercise machine with adjustable stride length according to claim 11, wherein the coupling unit further includes two pivot seats fixed to the two handlebars respectively, and the second bottom pivoting portions of the two second shafts are pivotally coupled to the two pivot seats, and the second top pivoting portion of each second shaft has a second axial shaft and a third axial shaft, and the first bottom pivoting portion of each first shaft is sheathed on the second axial shaft, and the second front pivoting portion of each pull rod is sheathed on the third axial shaft.

* * * * *